US005709023A

United States Patent [19]

Lallement

[11] Patent Number: 5,709,023

[45] Date of Patent: Jan. 20, 1998

[54] DEVICE AND METHOD FOR REDUCING THE EFFECTIVE CUTTING SURFACE OF A CUTTING MACHINE

[76] Inventor: Régis Lallement, 45 Chemin de l'Aoudougue-Rejouit, 33610 Cestas, France

[21] Appl. No.: 392,893

[22] PCT Filed: Aug. 12, 1993

[86] PCT No.: PCT/FR93/00808

§ 371 Date: Apr. 20, 1995

§ 102(e) Date: Apr. 20, 1995

[87] PCT Pub. No.: WO94/05471

PCT Pub. Date: Mar. 17, 1994

[30] Foreign Application Priority Data

Sep. 1, 1992 [FR] France ..... 92 10454

[51] Int. Cl.[6] ..... B26D 7/01

[52] U.S. Cl. ..... 29/559; 83/29; 83/451; 83/941; 269/21

[58] Field of Search ..... 83/56, 76.1, 76.6, 83/76.7, 76.9, 451, 940, 941, 19, 22, 29; 269/21; 29/559

[56] References Cited

U.S. PATENT DOCUMENTS

| | | | |
|---|---|---|---|
| 3,598,006 | 8/1971 | Gerber et al. | 83/941 X |
| 3,742,802 | 7/1973 | Maerz | 83/451 |
| 3,815,221 | 6/1974 | Pearl | 83/941 X |
| 4,205,835 | 6/1980 | Gerber . | |
| 4,434,691 | 3/1984 | LeBlond | 83/451 X |
| 4,452,113 | 6/1984 | Pearl | 83/941 X |
| 5,289,748 | 3/1994 | Kuchta et al. | 83/941 X |

FOREIGN PATENT DOCUMENTS

| | | |
|---|---|---|
| 2 033 514 | 12/1970 | France . |
| 2 583 332 | 12/1986 | France . |

*Primary Examiner*—Eugenia Jones
*Attorney, Agent, or Firm*—Jones & Askew, LLP

[57] ABSTRACT

The invention provides apparatus for reducing the working area for cutting on a cutting machine The apparatus comprises the cutting machine made up of a cutting table, the working area on the surface of the cutting table, an automatic cutting tool for cutting a stack of sheet material within the working area and a suction apparatus providing suction to the working area. An air-impervious film covers the stack and which holds the stack down within the working area when suction is applied. An air-impervious removable mask (6) covers a portion of the working area and is held in a determined position by fixing and positioning structures, such as a strip and an abutment attached to the mask. When the mask is held in the determined position, the working area is effectively reduced to a portion of the working area that is not covered by the mask.

7 Claims, 4 Drawing Sheets

DEVICE AND METHOD FOR REDUCING THE EFFECTIVE CUTTING SURFACE OF A CUTTING MACHINE

TECHNICAL FIELD

The present invention relates to a method and apparatus for reducing the working surface area on the cutting table of an automatic machine for cutting a stack of sheet material.

BACKGROUND OF THE INVENTION

Machines for automatic cutting of sheet material (cloth, skins, paper, . . . ), generally comprise a working table on which material to be cut is stacked, a film that is impervious to air covers the stack of material, suction means holds the stack of material down on the table by suction, and a moving cutting tool moves over the stack. For optimization purposes, the working table may itself be constituted by a conveyor that is also designed to transfer the stack.

It happens that some users of such machines need to cut sheets of width that is smaller than the working width of the cutting machine, or sheets that are of standard width but folded in two. During such cutting, a large portion of the cutting table is not covered in material, however the impervious film must nevertheless cover the entire cutting zone in order to provide the sealing necessary for the stack-holding suction. By proceeding in this way, half of the impervious film is used up needlessly, and that is quite wasteful.

An object of the present invention is to solve these drawbacks in satisfactory manner.

SUMMARY OF THE INVENTION

According to the invention, this object is achieved by means of apparatus for reducing the working area for cutting on a cutting machine for cutting a stack of sheet material, the machine being provided with an automatic moving cutting tool and with suction means for holding said stack covered in air-impervious film down on a cutting table, the apparatus being characterized in that it comprises an air-impervious removable mask designed to cover a portion of the table and held in a determined position by fixing and positioning means, together with detection means for detecting the position of said mask on said table and participating in the control of the cutting tool in such a manner as to prevent said mask being cut.

According to an advantageous characteristic of the invention, the fixing and positioning means comprise at least one strip provided with fixing and positioning orifices and secured to the end edge of the mask, and an abutment ensuring that said strip is held in place while the stack is being transferred.

According to another characteristic, the mask includes a porous strip that extends parallel to the boundary edge of the mask with the working surface of the table and said boundary edge is inclined relative to the longitudinal direction in which the stack is transferred.

According to yet another characteristic, the mask is made of a material that is sufficiently flexible to be rolled up in and paid out optionally from a roll disposed on one side of the table.

In a first embodiment, said strip is made in the form of an angle strip fixed to the leading edge of the cutting table relative to the advance direction of the stack, the vertical length of the angle strip forming said abutment.

In a particular embodiment, the detection means comprise sensors that detect the position of the mask and mechanical abutments associated with said sensors to avoid displacements of the cutting tool, thereby avoiding cutting said mask.

In another embodiment, said strip comprises two portions: a first portion secured to a first length of mask and designed to be fixed to the edge of the cutting table; and a second portion secured to a second length of the mask and movable in translation relative to said first portion, being suitable for locking in a position such that said first and second lengths of mask overlap, and said second portion of the strip carries said abutment.

The invention also provides a method of automatic cutting by means of a cutting machine provided with a moving cutting tool for cutting a stack of sheet material that is covered by a film which is impervious to air and that is held down on a working portion of a cutting table by means of suction apparatus, the remaining portion of the table being unoccupied, the method being characterized in that cutting is performed in said working portion of the table by previously fixing a removable air-impervious mask over the remaining portion, detecting the position of said mask, and controlling the cutting tool as a function of said detection in such a manner as to prevent subsequent cutting of said mask, and placing the air-impervious film on the stack so as to overlie the edge of the mask, the dimensions of the film being close to those of the stack.

The apparatus for reducing the working cutting area is preferably installed on the side opposite to the operator station so that the operator is close to the material to be cut. The apparatus itself includes a mask in the form of a removable panel or plate that is impervious to air and that is placed on the portion of the cutting surface which is not used. The working surface area for cutting is thus reduced, but cutting is performed in the same way. The impervious film can therefore be narrower so as to correspond to the cutting area that remains.

The apparatus of the invention thus makes it possible to economize impervious film and simultaneously to optimize production times.

Anther advantage lies in the possibility of having a plurality of rolls of impervious film of varying widths, and preferably matching the widths of stacks to be cut, the rolls co-operating with the removable mask to optimize consumption of impervious film.

Other characteristics and advantages of the present invention appear more clearly on reading the following description of various embodiments of the invention given as non-limiting examples.

BRIEF DESCRIPTION OF THE DRAWINGS

The description refers to the accompanying drawings, in which.

DESCRIPTION OF THE PREFERRED EMBODIMENTS

Figure 1:
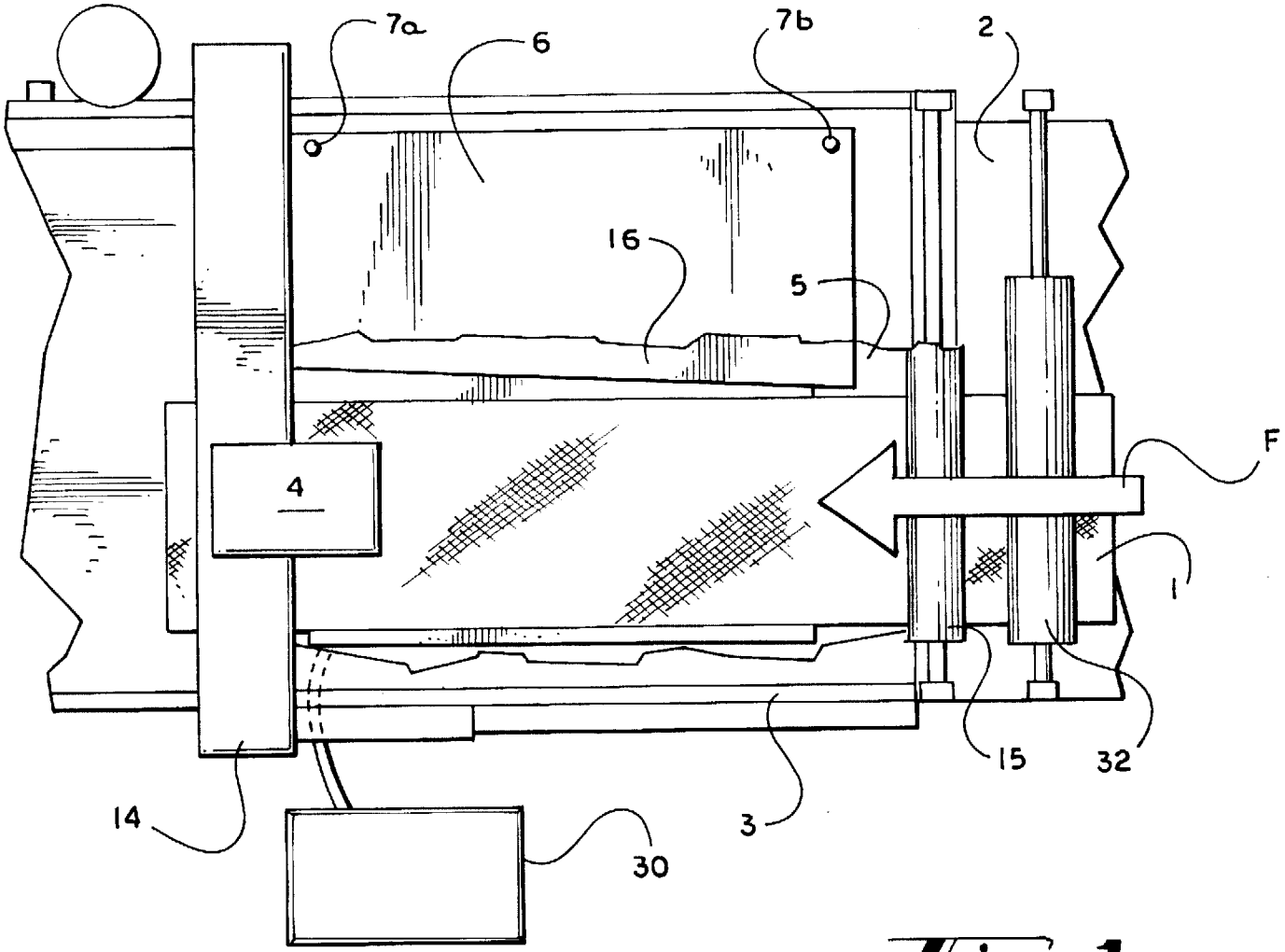
FIG. 1 is a plan view of the apparatus of the invention.

The apparatus for reducing the working cutting area as shown in FIG. 1 is designed to be fitted to a machine for cutting a stack 1 of sheet material. The machine is of the type comprising a spreading table 2 extended by a cutting table 3 optionally fitted with a conveyor, associated with an automatic moving cutting tool 4 carried by a beam 14 that is itself capable of moving, and a suction apparatus 30, also called a suction means, beneath the cutting table 3 for holding down the stack 1 which is covered in a film 5 that is impervious to air and that is paid out from at least one roll 15.

The apparatus of the invention comprises a removable mask 6 that is impervious to air and that is designed to cover a portion of the table 3. As a function of the required working surface area, the mask 6 is held in a determined position by fixing and positioning means. The apparatus of the invention also comprises detection means for detecting the position of the mask 6 and for participating in the control of the cutting tool 4, 14 so as to prevent the mask being cut.

The detection means, such as electrical or pneumatic sensors may be fixed on the table 3 so as to identify the position of the mask 6. The detected information is processed by the numerical control system of the cutting machine which is capable of actuating one or more mechanical abutments that correspond to the boundaries of the new cutting zone defined by installing the mask. These abutments are situated on the moving beam 14 along which the cutting head moves across the width of the working surface. In the event of an accident during cutting, the mechanical abutments serve to prevent the cutting head proceeding to destroy the impermeable mask.

The mask 6 includes a narrow porous strip 16 which extends substantially parallel to the edge marking the boundary between the mask 6 and the working surface of the table 3. In order to obtain the best possible sealing, the impervious film 5 is always wider than the working cutting zone. Thus, it overlies the edge of the mask 6 and the porous strip 16 serves to pass enough air so as to hold down the impervious film 5 by suction. The porous strip 16 serving to hold down the impervious film 5 may be implemented by perforating the mask 6. Another possibility consists in attaching the edge of the mask to a strip of material that is porous and that has the same flexibility as the mask.

In the embodiment shown in FIG. 1, the fixing and positioning means are constituted by at least two eyes *7a* and *7b* formed in the outside peripheral edge of the mask 6 so that the eyes *7a* and *7b* lie on a line that is substantially parallel to the advance direction F of the stack 1.

The eyes *7a* and *7b* co-operate fixing and positioning members (not shown) associated with the table 3 such as pegs or studs.

Under such conditions, various widths and thus various areas of mask 6 can be placed and fixed on the table 3 so as to match the mask to the width of the stack 1 that is to be cut.

Figure 2:
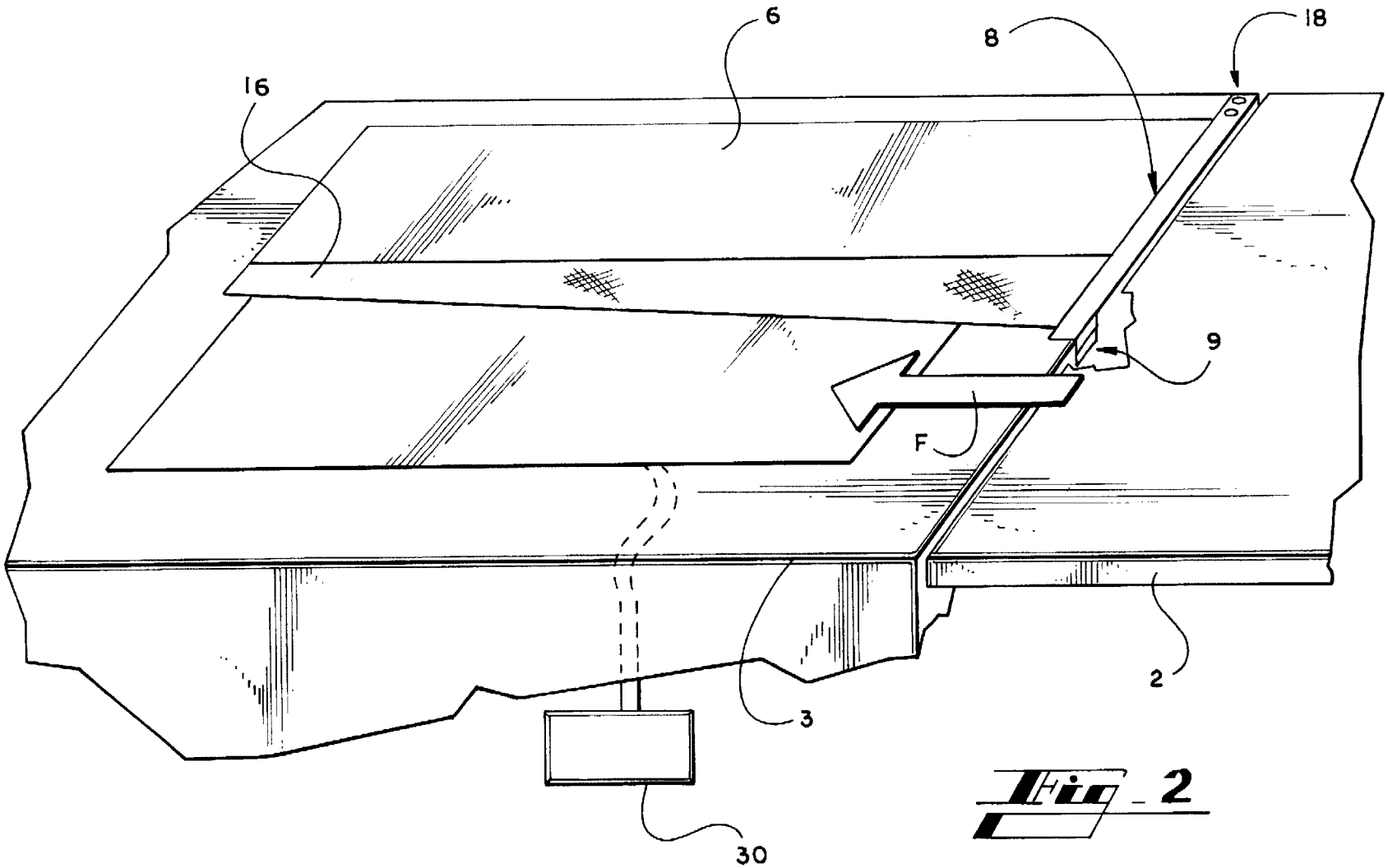
FIG. 2 is a perspective view of an embodiment of the apparatus of the invention.
Figure 3A:
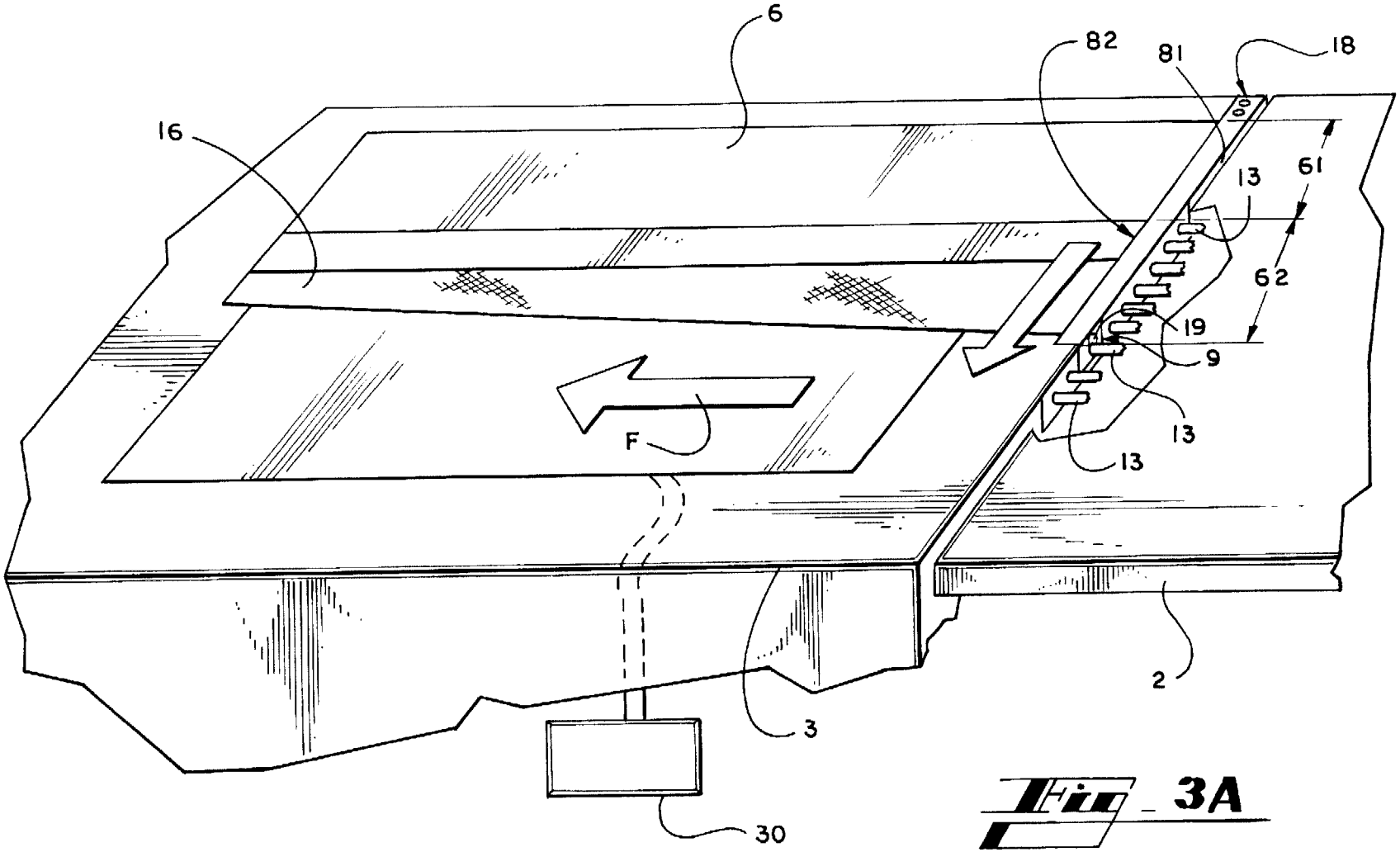
FIGS. 3*a* and 3*b* are perspective views of other embodiments.
Figure 3B:
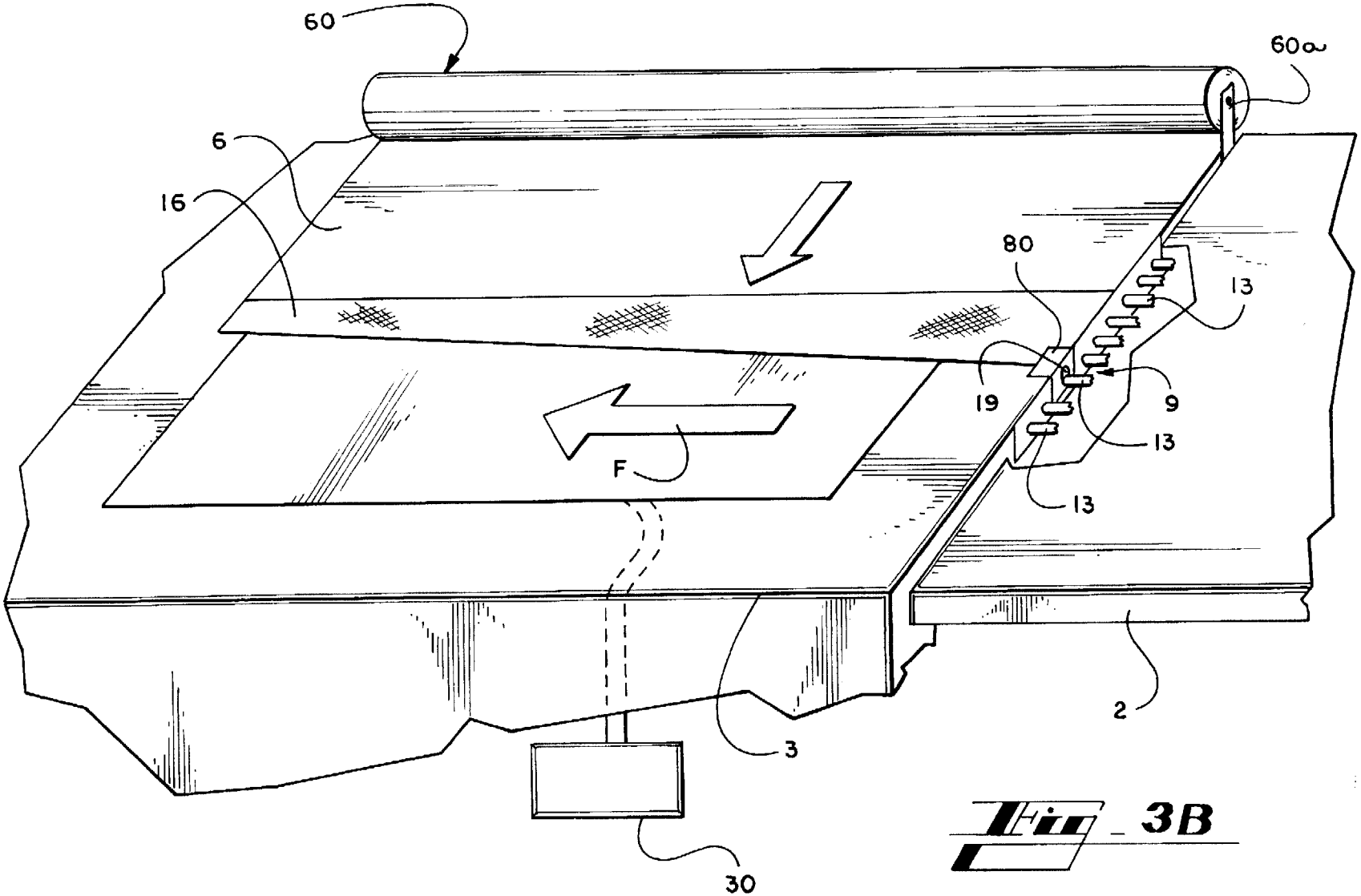

In the embodiment of the invention shown in FIG. 2, the fixing and positioning means are constituted by an angle strip 8 secured to the end edge of the mask 6, and an abutment 9 serving to retain the strip 8 while a stack 1 is being transferred (FIG. 1). Fixing holes 18 for the strip 8 are formed at the end of the strip opposite to the abutment 9 and they co-operate with fixing members (not shown) associated with the loading edge of the table 3 as defined by the advance direction F of the stack 1. The horizontal length of the angle strip lies on the table 3 while its vertical length forms the abutment 9. The abutment could also be formed by a lug (not shown) formed on the strip at its end opposite from the fixing holes 18. The cutting table 3 or the conveyor generally includes a bed that can be penetrated by the cutting tool (a vibrating blade, . . . ) and made up of slabs whose top faces are covered in bristles. The bristles extend perpendicularly to the stack 1 which they support and they are often of uneven length, thereby defining multiple small points.

Consequently, the air-impermeable mask 6 is made using a flexible material which must withstand the abrasive due to rubbing on the ends of the bristles of the cutting table while the conveyor is in operation. The mask 6 made in this way can be rolled up and stored while the cutting machine is being used at full width. Materials that can be used are of the following types: flexible plastics, mylar, rubber, paper, etc.

The air-impermeable mask 6 must project beyond the outside edges of the working portion of the cutting table or conveyor that it covers in order to establish good sealing and restrict leaks when suction is established.

While the cutting conveyor is advancing, the pointed ends of the bristles could damage the edge of the mask 6 defining the area of the working cutting zone. To avoid that drawback, the edge in question is inclined relative to the displacement direction of the cutting conveyor. This inclination may be defined by the fact that the longer end of the mask 6 perpendicular to the displacement direction F is situated at the end where the stack 1 is placed on the cutting machine. Thus, as the bristles move during stack advances, the ends of the bristles raise the edge of the impermeable mask 6 and cannot damage it.

In the embodiment of FIG. *3a*, the strip 8 comprises two portions 81 and 82. A first portion 81 is secured to a first length 61 of the mask 6 and is fixed to the edge of the table 3 by means of holes 18.

A second portion 82 is secured to a second length 62 of the mask 6 that includes the porous strip 16 and is movable in translation relative to the first portion 81, being suitable for being locked in a position such that the first and second lengths 61 and 62 of the mask 6 overlap. The second portion 82 of the strip 8 carries the abutment 9.

By causing the second portion 82 to slide after the first portion 81 has been fixed on the table 3, the operator can adjust the width of the mask to the desired working cutting area. The abutment 9 carried by the second portion 82 of the strip is provided with locking means for locking it in the corresponding position, said means being in the form of eyelets 19. For example they may be constituted by a single eyelet that the operator fixes to the loading edge of the table 3 which is provided with lugs 13. The operator chooses a lug 13 that corresponds to the desired width and fixes the corresponding eyelet 19 of the abutment 9 thereto.

In the embodiment of FIG. *3b*, the apparatus includes means for feeding a variable width of impervious mask 6. The mask 6 is then paid out over a determined width of the table 3 from a roll 60 disposed along one side of the table 3 and mounted on a support *60a* that is secured to said table. The free end of the mask 6 includes the porous strip 16 and it is fixed to the table 3 by means of a strip 80 similar to the second portion 82 of the strip shown in FIG. *3a*. The strip 80 likewise includes an abutment 9 provided with an eyelet 19 for locking by co-operating with lugs 13 of the table 3.

In embodiment of FIG. 1 the apparatus includes means for feeding different sizes of impermeable film 5, which means are preferably adjacent to and match the means for feeding the stack 1 to be cut. Thus, provision is made for rolls 15, 32 to be of a width close to that of the working cutting area so as to optimize consumption of the impervious film 5.

These feed means are disposed above the loading edge of the cutting table 3 and enable an appropriate width of impervious film to be spread over the stack 1.

I claim:

1. A method for reducing a working area for cutting on a cutting machine using a removable air-impervious mask, comprising the steps of:

fixing said removable air-impervious mask over a portion of a working area defined on a surface of a cutting table, said cutting table being part of said cutting machine;

placing an air-impervious film on a stack of sheet material in a remaining portion of said working area that is not occupied by said mask, the dimensions of said film being close to those of said stack such that said film overlies an edge of said mask; and holding down said film on said stack by applying suction from a suction apparatus connected beneath said working area, wherein said working area for cutting on said cutting machine is reduced by said portion of said working area that is covered by said mask.

2. The method according to claim 1 further comprising, in response to said fixing step, the step of matching the width of said stack to the width of one of a plurality of rolls of said film of varying widths.

3. In a cutting machine used for cutting a stack of sheet material said cutting machine comprising a cutting table to support said stack, said cutting table having a surface and a leading edge relative to a displacement direction (F) of said stack, a working area on the surface of said cutting table, said working area having a plurality of outside edges, an automatic moving cutting tool movably coupled to said cutting table and capable of cutting said stack within said working area, and a suction means beneath said working area for providing suction to said working area, an apparatus for reducing said working area for cutting on said cutting machine, the apparatus comprising:

an air-impervious film that covers said stack and holds said stack down on said working area in response to applying suction from said suction means;

an air-impervious removable mask that covers a portion of said working area and is held down on said portion of said working area in response to applying suction from said suction means; and a positioning means for holding said mask in a determined position on said cutting table in order to cover said portion of said working area and to reduce said working area by said portion of said working area that is covered by said mask, said positioning means comprising at least one strip secured to an end edge of said mask and an abutment secured to said at least one strip ensuring that said strip is held in place while said stack is being transferred across said cutting table.

4. The apparatus according to claim 3, wherein said strip is made in the form of an angle and is fixed to said leading edge of said cutting table, a vertical length of said angle strip forming said abutment.

5. The apparatus according to claim 3, wherein said snip comprises two portions:

a first portion of said strip secured to a first length of said mask, said first portion being fixed to said leading edge of said cutting table; and a second portion of said snip secured to a second length of said mask, said second portion being movable in translation relative to said first portion and said second portion being suitable for locking in a position such that said first length of said mask and said second length of said mask overlap.

6. The apparatus according to claim 5, wherein said second portion of said snip is secured to said abutment.

7. In a cutting machine used for cutting a stack of sheet material, said cutting machine comprising a cutting table to support said stack, said cutting table having a surface and a leading edge relative to a displacement direction (F) of said stack, a working area on the surface of said cutting tablet said working area having a plurality of outside edges, an automatic moving cutting tool movably coupled to said cutting table and capable of cutting said stack within said working area, and a suction means beneath said working area for providing suction to said working area, an apparatus for reducing said working area for cutting on said cutting machines, the apparatus comprising:

an air-impervious film that covers said stack and holds said stack down on said working area in response to applying suction from said suction means;

an air-impervious removable mask that covers a portion of said working area and is held down on said portion of said working area in response to applying suction from said suction means; and a positioning means for holding said mask in a determined position on said cutting table in order to cover said portion of said working area and to reduce said working area by said portion of said working area that is covered by said mask, said positioning means comprising at least two eyes formed in an outside peripheral edge of said mask in such a manner that said at least two eyes lie on a line that is substantially parallel to said displacement direction (F) of said stack.

* * * * *

UNITED STATES PATENT AND TRADEMARK OFFICE

CERTIFICATE OF CORRECTION

PATENT NO. : 5,709,023

DATED : January 20, 1998

INVENTOR(S) : Regis Lallement

It is certified that error appears in the above-identified patent and that said Letters Patent is hereby corrected as shown below:

Col. 6, line 3: Please replace "snip" with --strip--.

Col. 6, line 9: Please replace "snip" with --strip--.

Col. 6, line 16: Please replace "snip" with --strip--.

Signed and Sealed this

Seventh Day of April, 1998

Bruce Lehman

*Attest:*

BRUCE LEHMAN

*Attesting Officer*

*Commissioner of Patents and Trademarks*